US008245341B2

(12) United States Patent
Oh

(10) Patent No.: US 8,245,341 B2
(45) Date of Patent: Aug. 21, 2012

(54) SYMMETRICAL PRESSURE RELIEF FOAM MATTRESS

(75) Inventor: Suk Kan Oh, Xiamen (CN)

(73) Assignee: Zinus, Inc., Hayward, CA (US)

( * ) Notice: Subject to any disclaimer, the term of this patent is extended or adjusted under 35 U.S.C. 154(b) by 404 days.

(21) Appl. No.: 12/455,700

(22) Filed: Jun. 6, 2009

(65) Prior Publication Data

US 2010/0223734 A1 Sep. 9, 2010

(30) Foreign Application Priority Data

Mar. 4, 2009 (CN) ..... 2009 1 0111206

(51) Int. Cl.
*A47C 27/15* (2006.01)

(52) U.S. Cl. ..... 5/727; 5/722; 5/740

(58) Field of Classification Search ..... 5/727–730, 5/724, 740

See application file for complete search history.

(56) References Cited

U.S. PATENT DOCUMENTS

| | | | | | |
|---|---|---|---|---|---|
| 3,846,857 | A * | 11/1974 | Weinstock | 5/727 |
| 4,147,825 | A | 4/1979 | Talalay | 418/138 |
| 4,509,219 | A | 4/1985 | Yagi | 5/481 |
| 4,580,301 | A | 4/1986 | Ludman et al. | 5/464 |
| 4,924,542 | A | 5/1990 | Yamaguchi | 5/481 |
| 5,325,551 | A | 7/1994 | Tappel et al. | 5/453 |
| 5,749,111 | A | 5/1998 | Pearce | 5/652 |
| 5,850,648 | A | 12/1998 | Morson | 5/724 |
| 6,026,527 | A | 2/2000 | Pearce | 5/654 |
| 6,199,234 | B1 | 3/2001 | Srour et al. | 5/736 |
| 6,370,718 | B1 | 4/2002 | Schmid | 5/726 |
| 6,413,458 | B1 | 7/2002 | Pearce | 264/141 |
| 6,854,143 | B2 | 2/2005 | Sharples | 5/724 |
| 6,854,144 | B1 | 2/2005 | Mehring, Jr. | 5/727 |
| 6,865,759 | B2 | 3/2005 | Pearce | 5/655.5 |
| 6,948,205 | B2 | 9/2005 | Van Der Wurf et al. | 5/718 |
| 7,036,172 | B2 | 5/2006 | Torbet et al. | 5/727 |
| 7,060,213 | B2 | 6/2006 | Pearce | 264/176.1 |
| 7,191,483 | B2 * | 3/2007 | Hochschild | 5/740 |
| 7,334,280 | B1 | 2/2008 | Swartzburg et al. | 5/724 |
| 7,426,767 | B2 | 9/2008 | Mossbeck | 5/736 |
| 7,865,989 | B2 * | 1/2011 | Steppat et al. | 5/740 |
| 2004/0226099 | A1 | 11/2004 | Pearce | 5/655.5 |

* cited by examiner

*Primary Examiner* — Fredrick Conley
(74) *Attorney, Agent, or Firm* — Imperium Patent Works; Darien K. Wallace

(57) ABSTRACT

A symmetrical pressure relief foam mattress includes an upper foam layer placed on a zoned foam layer. A plurality of cylindrical holes are distributed throughout each of a first, a second and a third lateral region of the zoned foam layer. The first lateral region is less than twelve inches wide and has a middle that is within eighteen inches of the top of the zoned foam layer. The third lateral region is also less than twelve inches wide and has a middle that is within eighteen inches of the bottom of the zoned foam layer. The second lateral region has a middle disposed at the center axis of the zoned foam layer. The middle of both the first and third lateral regions is about fifteen inches from the edge of the mattress regardless of which end the consumer chooses to use as the head of the mattress.

20 Claims, 3 Drawing Sheets

SYMMETRICAL PRESSURE RELIEF FOAM MATTRESS

CROSS REFERENCE TO RELATED APPLICATION

This application is based on and hereby claims the benefit under 35 U.S.C. §119 from Chinese Patent Application No. 200910111206.0,filed on Mar. 4, 2009,in China, the contents of which are hereby incorporated by reference. This application is a continuation-in-part of Chinese Application No. 200910111206.0.

TECHNICAL FIELD

The present invention relates to mattresses, and in particular to a zoned foam mattress.

BACKGROUND INFORMATION

Today foam pads are accepted by the general public for family use depending on their appropriate softness or hardness. Where a foam pad is used as a mattress, upon lying down on the mattress, different portions of the body exert different pressures on the mattress. Therefore, a foam mattress with a uniform degree of hardness fails completely to satisfy the comfort level required by the body. If a relatively soft foam mattress is selected, then the middle portion of the body feels comfort, while the support provided for the head and feet of the body thereby appears to be insufficient. On the other hand, by selecting a relatively hard foam mattress, although the amount of support for the head and feet of the body is sufficient, the middle portion of the body is caused to feel hard and uncomfortable. Furthermore, the degree of softness or hardness of the foam is set by differently adjusting the ratios among various substances contained in the raw materials. One solution is to splice together at least three pieces of foam having different densities. The foam pieces at the head and foot of the mattress are harder than the piece of foam in the middle of the mattress.

Forming a mattress by slicing foam pieces having different degrees of hardness, however, complicates the manufacturing process and adds to the cost of the mattress. A method is sought for making a zoned foam mattress that does not require gluing together sliced pieces of foam to form the zones of different hardness.

SUMMARY

A symmetrical pressure relief foam mattress includes an upper foam layer with a lower side and a zoned foam layer with an upper side. The lower side of the upper foam layer is placed on the upper side of the zoned foam layer. A plurality of cylindrical holes are distributed throughout each of a first, a second and a third lateral region of the zoned foam layer. The first lateral region is less than twelve inches wide and has a middle that is within eighteen inches of the top of the zoned foam layer. The third lateral region is also less than twelve inches wide and has a middle that is within eighteen inches of the bottom of the zoned foam layer. The second lateral region has a middle disposed at the center axis of the zoned foam layer. The middle of both the first and third lateral regions is about fifteen inches from the edge of the mattress regardless of which end the consumer chooses to use as the head of the mattress.

A foam mattress has lateral regions within a middle portion and a top portion that correspond to the contact positions of the mattress to the hips and shoulders of a person lying on the mattress. A plurality of holes through the foam mattress are distributed in the lateral regions.

The plurality of holes laterally distributed on the foam mattress cause the amplitude of deformation of the foam to increase and the contacting hardness of the foam to decrease at the contact positions of the mattress with the shoulders and hips of the reclining person. The portions of the mattress in contact with the shoulders and hips of a body lying on the mattress have a greater degree of deformation and thus are relatively soft. By allowing the mattress to more closely comply with the kinesiology of the recumbent body, the holes enhance the degree of comfort for the body portions in contact with the foam mattress.

There are lateral regions of distributed holes in the top portion, the middle portion and the bottom portion of the foam mattress. The holes are formed through one-step molding in the foam molding process for the foam pad. Alternatively, holes are punched through an already molded foam pad. The holes may be through holes or countersunk holes. The distances between the middle portion and the top portion and between the middle portion and the bottom portion are the same. Thus, the lateral regions of holes are symmetrically located with respect to the center axis of the mattress. Regardless of whether the mattress is placed on the bed with one end facing the top or bottom of the bed, it is ensured that the holes for changing the hardness of the foam zones are present without fail within the region of the mattress that contacts the shoulders of the reclining body. The shoulder region of holes is in the proper place regardless of how the mattress is placed on the bed.

The symmetrical pressure relief mattress can be easily manufactured and conforms to the kinesiology of the reclining body on the mattress. The points of contact between the different portions of the human body and the pressure relief regions allow the spine of the recumbent person to remain straight and the person to one feel more comfortable.

Further details and embodiments are described in the detailed description below. This summary does not purport to define the invention. The invention is defined by the claims.

BRIEF DESCRIPTION OF THE DRAWINGS

The accompanying drawings illustrate embodiments of the invention.

DETAILED DESCRIPTION

Figure 1:
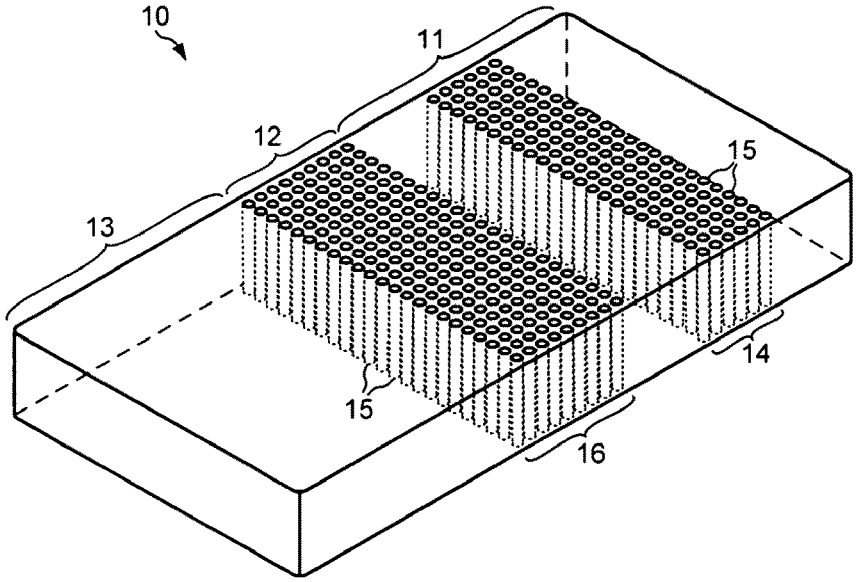
FIG. 1 is a perspective view of a foam mattress according to a first embodiment of the present invention.

FIG. 1 shows a pressure relief foam mattress 10 of a first embodiment of the present invention that includes a top portion 11, a middle portion 12 and a bottom portion 13. Within top portion 11 there is a lateral region 14 with a plurality of distributed cylindrical holes 15. Lateral region 14 corresponds to the contact position between mattress 10 and the shoulders of a person reclining thereon. There is also a lateral region 16 corresponding to the contact position between mattress 10 and the hips of a person reclining thereon. Holes 15 may be formed through one-step molding in the foam molding process for the foam mattress. A plurality of cylinders are provided inside the mold for the foam. Alternatively, the holes 15 are punched through an already molded foam mattress. Using a foam mold saves on raw materials for the foam as foam is never formed in the area of the holes and is not discarded as when the holes are punched out. Holes 15 may be through holes or countersunk holes. The cylindrical holes 15 may have circular or non-circular cross sections, such as ovals, polygons or triangles. By providing holes 15 in the lateral regions, the amplitude of deformation of the foam may be increased so as to decrease the contacting hardness of the foam. The contacting hardness is sometimes called the indentation load deflection (ILD). A harder foam exhibits a higher ILD, which is the force required to compress the foam by specified percentage in a predetermined manner. The degree of softness or hardness of the various lateral zones of the mattress can be adjusted by varying the spacing and diameter of the holes 15 and by varying the depth of the holes where the holes are not through holes. For example, the holes can be spaced farther apart to reduce the softness. In another example, the holes penetrate only part way into foam mattress 10. In order to manufacture mattress 10 with holes 15 that are less than the full thickness of mattress 10, the holes are preferably formed using cylindrical molds as opposed to by punching the holes part pay into mattress 10 and then breaking off each cut cylinder of foam.

Holes 15 allow that portion of mattress 10 in contact with the shoulders of a person lying thereon to be softer and to have a greater degree of deformation. Not only does the recumbent person feel more comfortable, but the person's spine remains straighter when the shoulders can sink farther into the mattress. Holes 15 are adapted to have a spacing and a diameter that impart an indentation load deflection (ILD) to the lateral region 14 that allow the shoulders of a person lying on his or her back on mattress 10 to sink into the mattress so as to keep the person's spine straight. Similarly, the recumbent person's hips that are in contact with lateral region 16 also sink into the mattress more than does the torso because holes 15 allow the foam to deform to a greater extent in lateral region 16. Again, the spine can remain straighter if both the hips and the shoulders of the person lying on his or her back sink farther into the mattress than does the person's torso and legs. Thus, pressure relief foam mattress 10 provides variable support that maintains the natural curvature of the body in compliance with kinesiology and effectively enhances the degree of comfort for the body portions in contact with the mattress.

Since a protective cover is wrapped around the exterior of the foam layer or layers of mattress 10, the orientation of top portion 11 is indicated on the outside of the protective cover. In this manner, the user is informed of which end of mattress 10 corresponds to the top portion 11 that will come into contact with the shoulders of a person lying on the mattress. Some consumers may not consider which orientation of mattress 10 is correct, and thus may sleep with their shoulders on bottom portion 13. These consumers would not benefit from the lower ILD zone of lateral region 14 intended for the shoulders.

Figure 2:
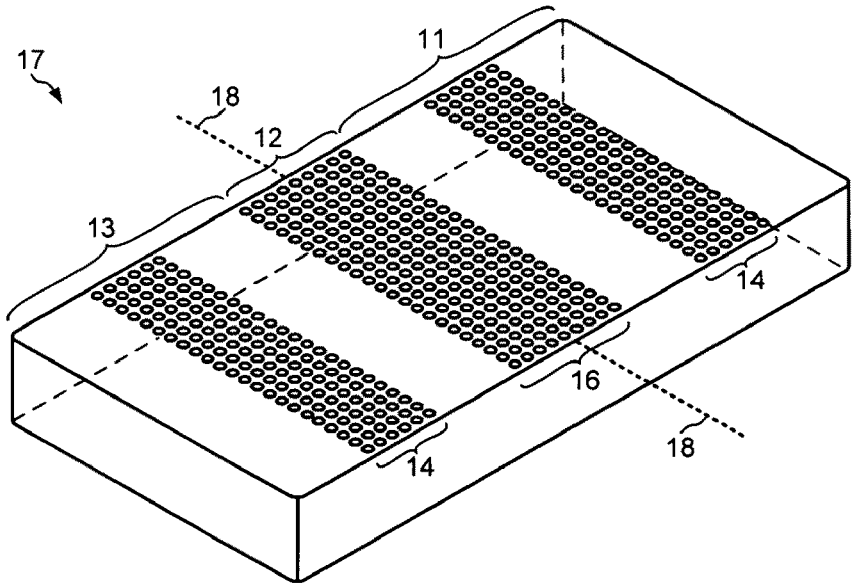
FIG. 2 is a perspective view of a foam mattress according to a second embodiment of the present invention.

FIG. 2 shows a second embodiment of the present invention in which a symmetrical pressure relief foam mattress 17 includes a lateral region 14 in both top portion 11 and bottom portion 13. Both lateral regions 14 are disposed symmetrically to the center axis 18 of mattress 17. By placing two symmetrical lateral regions 14 in top portion 11 and bottom portion 13, the consumer cannot lay the mattress down on the bed frame in the incorrect orientation with the head of the mattress towards the foot of the bed frame. Regardless of how the mattress is laid down on the bed, the holes 15 for changing the hardness of the foam are present without fail within the correct area of the mattress to contact the shoulders of the lying person.

Figure 3:
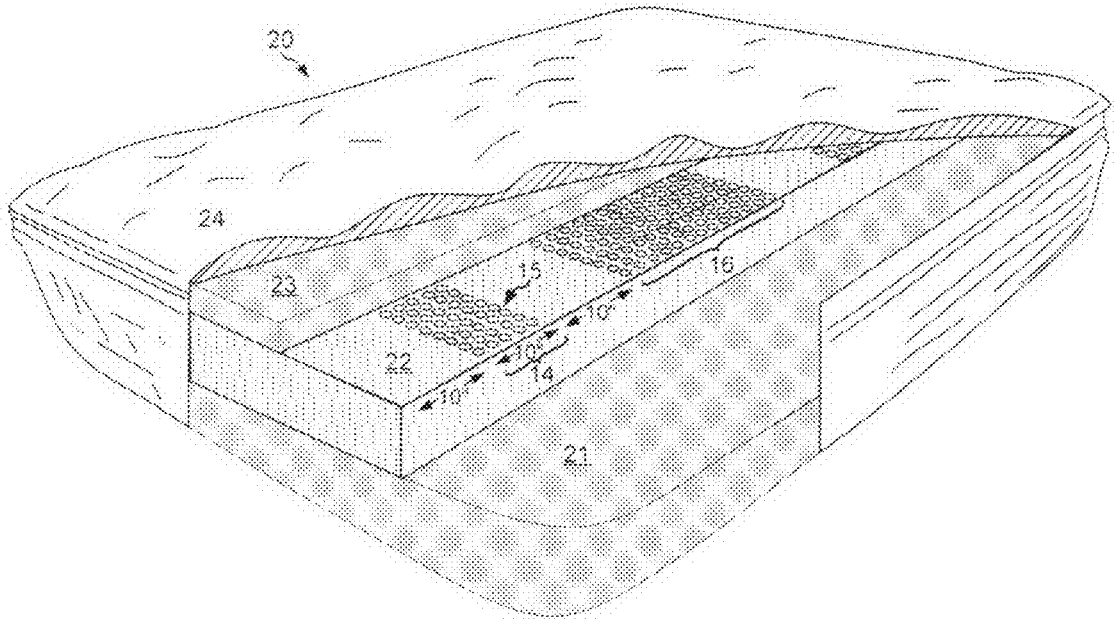
FIG. 3 is a cut-away perspective view of another embodiment of a symmetrical pressure relief foam mattress.

FIG. 3 shows a cut-away perspective view of another embodiment of a symmetrical pressure relief foam mattress 20. Mattress 20 includes a bottom foam layer 21, a middle foam layer 22 with holes 15, and a top foam layer 23. Bottom layer 21 provides support for the other layers and is made of HD foam. Middle layer 32 is made of a softer polyurethane foam than the HD foam. And top layer 23 includes memory foam (visco-elastic polyurethane foam) that contains green tea and is colored green. A person using mattress 20 lies directly on layer 23 through a thin quilted fiber padding 24 of the mattress cover. The green tea in top layer 23 acts as an antiodorant such that less of the chemical smell of the memory foam is perceived by the user. In addition, people tend to perspire more while sleeping on memory foam. The bacteria and mold that would otherwise develop in the moist environment of the memory foam are killed by the green tea additive to the foam.

Mattress 20 is configured to provide optimum support for the largest percentage of North American consumers. The lateral region 14 is about ten inches wide. In addition, lateral region 14 is about ten inches from the top or bottom of the mattress. There are also about ten inches between lateral region 14 and middle lateral region 16. The average consumer, regardless of body height, sleeps with his or her head the same distance from the top of the mattress. Thus, the average North American consumer sleeps with his or her shoulders about fifteen inches from the top of the mattress. The middle of one of lateral regions 14 is about fifteen inches from the "head" of mattress 20 regardless of which end of mattress 20 the consumer chooses to use as the head. The middle lateral region 16 of holes 15 occupies the entire length of mattress 20 from thirty inches from the bottom of the mattress to thirty inches from the top of the mattress. Thus, for a 75-inch long twin size mattress, middle lateral region 16 is about fifteen inches wide. For an 80-inch long queen size mattress, middle lateral region 16 is about twenty inches wide.

Mattress 20 does not have a foam zone that is specifically tailored to the legs of a person reclining on the mattress. Instead, a consumer's legs lie on a lateral region positioned for the shoulders. The benefit of always positioning a consumer's shoulders correctly over a lateral region 14, regardless of whether the consumer lies toward the top or bottom of mattress 20, outweighs the lack of optimum leg support. Providing a foam zone with an indentation load deflection (ILD) specifically suited to support a person's legs contributes much less to keeping the reclining person's spine straight than does positioning lateral regions with the appropriate ILDs beneath the person's shoulders and hips. Moreover, foam zones intended to support the legs are often ineffective. Where a tall man and a short woman are reclining on the same mattress, their shoulders will likely rest at the same distance from the end of the mattress, whereas their legs will likely not rest in the same lateral region. Thus, any foam zone with an ILD specifically suited to support a person's legs would not be in the appropriate position for both the tall man and the short woman. Instead of offering multiple ineffective indentation zones, mattress 20 provides a shoulder foam zone that is always correctly positioned and a variable width hip foam zone that is appropriate for the largest percentage of North American consumers.

Figure 4:
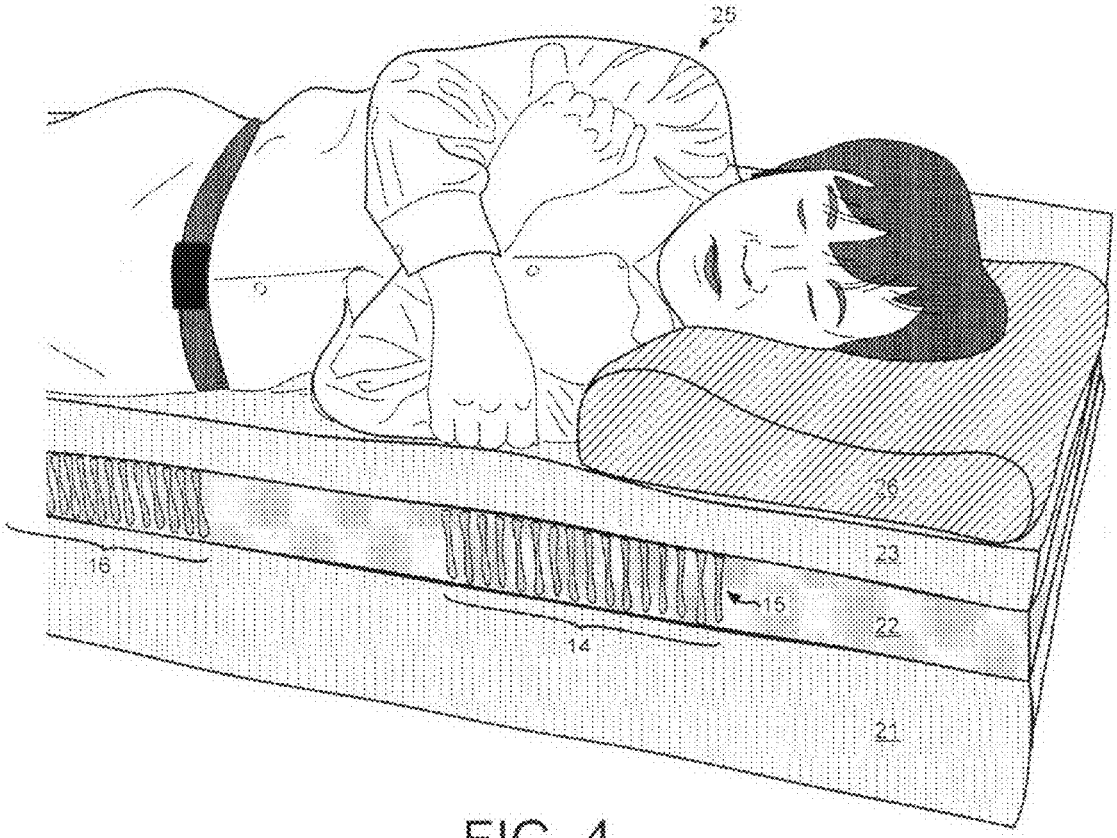
FIG. 4 illustrates a person lying on his side on the mattress of FIG. 3 from which the cloth covering and quilted fiber padding have been removed for illustrative purposes.

FIG. 4 shows a person 25 lying on his side on mattress 20 from which the cloth covering and quilted fiber padding 24 have been removed for illustrative purposes. The head of person 25 is resting on a contoured pillow 26. Pillow 26 extends from the top of mattress 20 to about the middle of lateral region 14. The shoulders of person 25 abut pillow 26 and are thus positioned over the middle of lateral region 14. Lateral region 14 has a lower indentation load deflection (ILD) than do other regions of middle foam layer 22 immediately adjacent to lateral region 14. The hips of person 25 are positioned over the lateral region 16. The lower ILD of lateral region 14 allows the left shoulder of person 25 to sink into mattress 20 so as to keep the spine of person 25 straighter than if the left shoulder did not sink as deeply into mattress 20.

By adopting the solution described above, a plurality of holes are laterally distributed on the foam mattress at the contact positions of the mattress with the shoulders and hips of a person recumbent thereon. By locally providing holes through the foam mattress, the amplitude of deformation of the foam between the holes is increased so as to decrease the contacting hardness and the ILD of the foam region. The portion of the mattress in contact with the shoulders of the reclining person has a greater degree of deformation and is thus relatively softer. Similarly, the portion of the mattress in contact with the hips of the reclining person also has a greater degree of deformation. Therefore, the foam mattress can effectively enhance the degree of comfort for the body portions in contact with the mattress and can provide a variable degree of support required to maintain the body's natural curvature.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A mattress comprising:

an upper foam layer with a lower side; and a zoned foam layer with an upper side, a center axis, a top and a bottom, wherein the lower side of the upper foam layer is adjacent to the upper side of the zoned foam layer, wherein the zoned foam layer has a first lateral region, a second lateral region and a third lateral region, wherein a plurality of cylindrical holes are distributed throughout each of the first, second and third lateral regions, wherein the first lateral region is less than twelve inches wide and has a middle that is within eighteen inches of the top of the zoned foam layer, wherein the third lateral region is less than twelve inches wide and has a middle that is within eighteen inches of the bottom of the zoned foam layer, and wherein the second lateral region has a middle disposed at the center axis of the zoned foam layer.

2. The mattress of claim 1, wherein the first lateral region and the third lateral region are disposed symmetrically to the center axis of the zoned foam layer.

3. The mattress of claim 1, wherein the first lateral region has a width that equals that of the third lateral region, wherein the zoned foam layer has a length, and wherein the second lateral region is as wide as the length of the zoned foam layer minus six times the width of the first lateral region.

4. The mattress of claim 1, wherein the cylindrical holes pass entirely through the zoned foam layer.

5. The mattress of claim 1, wherein the upper foam layer is made of memory foam, and the zoned foam layer is made of polyurethane foam.

6. The mattress of claim 1, wherein the holes are adapted to have a spacing and a diameter that impart an indentation load deflection (ILD) to the first lateral region that allow a person's shoulders to sink into the mattress so as to keep the person's spine straight.

7. The mattress of claim 1, wherein the first lateral region has a lower indentation load deflection (ILD) than do other regions of the zoned foam layer immediately adjacent to the first lateral region.

8. The mattress of claim 1, wherein the cylindrical holes penetrate only part way into the zoned foam layer.

9. A method comprising:

forming a first plurality of cylindrical holes in a first lateral region of a zoned foam layer, wherein the zoned foam layer has an upper side, a top, a bottom and a center axis;

forming a second plurality of cylindrical holes in a second lateral region of the zoned foam layer;

forming a third plurality of cylindrical holes in a third lateral region of the zoned foam layer; and placing a lower side of an upper foam layer on top of the upper side of the zoned foam layer, wherein the first lateral region is less than twelve inches wide and has a middle that is within eighteen inches from the top of the zoned foam layer, wherein the third lateral region is less than twelve inches wide and has a middle that is within eighteen inches from the bottom of the zoned foam layer, and wherein the second lateral region has a middle disposed at the center axis of the zoned foam layer.

10. The method of claim 9, wherein the first lateral region and the third lateral region are disposed symmetrically to the center axis of the zoned foam layer.

11. The method of claim 9, wherein the cylindrical holes pass entirely through the zoned foam layer.

12. The method of claim 9, wherein the cylindrical holes penetrate only part way into the zoned foam layer.

13. The method of claim 9, wherein the first lateral region has a lower indentation load deflection (ILD) than do other regions of the zoned foam layer immediately adjacent to the first lateral region.

14. The method of claim 9, wherein the holes are adapted to have a spacing and a diameter that impart an indentation load deflection (ILD) to the first lateral region that allow a person's shoulders to sink into the mattress so as to keep the person's spine straight.

15. A mattress comprising:

an upper foam layer with a lower side;

a zoned foam layer with an upper side, a top and a bottom, wherein the lower side of the upper foam layer is adjacent to the upper side of the zoned foam layer, and wherein the zoned foam layer has a first shoulder zone and a second shoulder zone; and means for imparting to the first shoulder zone and the second shoulder zone a lower indentation load deflection (ILD) than that exhibited by other regions of the zoned foam layer immediately adjacent to the first shoulder zone and the second shoulder zone, wherein the first shoulder zone is less than twelve inches wide and has a middle that is within eighteen inches of the top of the zoned foam layer, and wherein the second shoulder zone is less than twelve inches wide and has a middle that is within eighteen inches of the bottom of the zoned foam layer.

16. The mattress of claim 15, wherein the zoned foam layer has a hip zone and a center axis, and wherein the hip zone has a middle disposed at the center axis of the zoned foam layer, and wherein the hip zone has a lower ILD than that exhibited by other regions of the zoned foam layer immediately adjacent to the hip zone.

17. The mattress of claim 15, wherein the zoned foam layer has a center axis, and wherein the first shoulder zone and the second shoulder zone are disposed symmetrically to the center axis of the zoned foam layer.

18. The mattress of claim 15, wherein the means imparts an ILD to the first shoulder zone that allows a person's shoulders to sink into the mattress so as to keep the person's spine straight.

19. The mattress of claim 15, wherein the means is formed using a mold.

20. The mattress of claim 15, wherein the upper foam layer is made of memory foam, and wherein the zoned foam layer is made of polyurethane foam.

* * * * *